US005856073A

United States Patent [19]

Buongiorne et al.

[11] Patent Number: 5,856,073

[45] Date of Patent: Jan. 5, 1999

[54] TWO-PART PHOTOGRAPHIC CHEMICAL STABILIZING KIT AND METHOD OF PHOTOGRAPHIC PROCESSING

[75] Inventors: Jean M. Buongiorne, Brockport; Stephen J. Waffle, Ontario; Hugh G. McGuckin, Rochester; John S. Badger, Webster, all of N.Y.

[73] Assignee: Eastman Kodak Company, Rochester, N.Y.

[21] Appl. No.: 955,009

[22] Filed: Oct. 20, 1997

[51] Int. Cl.[6] ..... G03C 7/407

[52] U.S. Cl. ..... 430/429; 430/372; 430/463

[58] Field of Search ..... 430/372, 429, 430/463

[56] References Cited

U.S. PATENT DOCUMENTS

| | | | |
|---|---|---|---|
| 4,105,431 | 8/1978 | Lewis et al. | 504/156 |
| 4,173,643 | 11/1979 | Law | 514/372 |
| 4,786,583 | 11/1988 | Schwartz | 430/372 |
| 4,923,782 | 5/1990 | Schwartz | 430/372 |
| 5,529,890 | 6/1996 | McGuckin et al. | 430/429 |
| 5,534,396 | 7/1996 | McGuckin et al. | 430/463 |
| 5,645,980 | 7/1997 | McGuckin et al. | 430/372 |

FOREIGN PATENT DOCUMENTS

| | | |
|---|---|---|
| 0 638 845 A1 | 8/1993 | European Pat. Off. . |

*Primary Examiner*—Hoa Van Le
*Attorney, Agent, or Firm*—J. Lanny Tucker

[57] ABSTRACT

Silver halide photographic color films can be effectively stabilized using a chemical stabilizing kit of two concentrated chemical solutions that are mixed and diluted at least 5:1 when used. Each concentrated chemical solution contains some of the necessary chemicals for the processing solution, but keeping them individually packaged prior to use prevents biocide instability and other problems when all of the chemical components are mixed in concentrated form. One concentrated chemical solution includes hexamethylenetetramine and an alcoholamine such as diethanolamine. The other concentrated chemical solution includes the biocide(s) and one or more surfactants.

20 Claims, No Drawings

TWO-PART PHOTOGRAPHIC CHEMICAL STABILIZING KIT AND METHOD OF PHOTOGRAPHIC PROCESSING

FIELD OF THE INVENTION

This invention relates to the field of silver halide photographic processing. In particular, it relates to a chemical kit of two concentrated solutions that are useful for providing a photographic stabilizing solution, and to a method of using the stabilizing solution for processing photographic silver halide color films.

BACKGROUND OF THE INVENTION

The processing of photographic silver halide color films generally involves the steps of color development, bleaching, fixing, stabilizing and drying. The stabilizing bath is generally used as the final chemical processing step in order to reduce stain and/or to enhance dye stability, as well as to wash off the last residues of processing chemicals from previous steps. Dye stability is believed to be affected by the presence of unreacted dye forming coupler in the silver halide emulsion layers of the film, which coupler can then react to degrade the color image. Dye stability is also influenced by temperature, humidity, air quality and exposure to light. In certain instances, the magenta dye forming coupler tends to fade more rapidly than other dye forming couplers, and a stabilizing formulation often includes a compound that releases a methylene group to inhibit magenta dye fade. Stabilizing solutions are aqueous formulations containing the various components necessary to provide dye stability as well as to reduce scumming and chemical residues on the film. In some instances, the stabilizing formulation may be in the form of a solid that is dissolved in water in the processing bath.

Typical known stabilizing solutions often contain formalin (or a formaldehyde precursor) or another aldehyde, as the methylene-releasing compound. See for example, U.S. Pat. No. 5,273,864 (Ishikawa et al). Formaldehyde possesses the added benefit of high volatility, so that any residual formaldehyde on the base side of the film is readily removed in the drying step. However, in recent years, concerns over the hazardous effects of formaldehyde have stimulated the development of alternative stabilizing compounds. Hence, alternative aldehydes have been used, as described in U.S. Pat. No. 5,362,609 (Kuwae et al).

Hexamethylenetetramine (HMTA) is an acceptable substitute for some or all of the formaldehyde in the stabilizing solutions. As described in U.S. Pat. No. 5,529,890 (McGuckin et al), HMTA is a water-soluble, nonvolatile, crystalline compound with superior methylene group-releasing properties. However, sometimes this compound leaves residue on the dried films, so there have been efforts to reduce this effect by adding certain surfactants to the stabilizing solution. A particularly useful combination of an anionic sulfate or sulfonate and a nonionic polyethoxylated surfactant is described in the noted McGuckin et al patent.

It is also known to include in stabilizing solutions one or more metal ion sequestering agents and alcoholamines, such as diethanolamine, as described in U.S. Pat. No. 4,927,746 (Schwartz). The alcoholamines are considered useful to reduce sulfurization (or sulfur precipitation) resulting from the carryover of a thiosulfate fixing agent into the stabilizing bath. Sulfurization is a serious problem resulting in fouling of processing equipment and the processed film. An "alkanolamine" refers to a compound in which the nitrogen atom is directly attached to a hydroxyalkyl group, examples of which are defined hereinbelow.

Still further, it is known to include one or more biocides in stabilizing solutions in order to retard biological growth. Various biocides are known including various isothiazolones such as 1,2-benzisothiazolin-3-one commercially available under the trademark PROXEL™ GXL from Zeneca, and the mixture of 5-chloro-2-methyl-4-isothiazolin-3-one and 2-methyl-4-isothiazolin-3-one found in a product commercially available from Rohm and Haas under the trademark KATHON™ LX.

One commercially available stabilizing solution useful for processing silver halide color negative films includes HMTA, diethanolamine, a mixture of surfactants, a sequestering agent and a PROXEL™ GXL biocide. It was found that under certain conditions and in certain processing machines, biocidal effectiveness was reduced for some reason and biogrowth would appear. Obviously, there is a need to provide a more effective biocidal effect in such solutions. An effort was made to replace the PROXEL™ GXL biocide with the KATHON™ LX biocide in stabilizing solution concentrates because it was expected that the isothiazolone compounds would be interchangeable. However, we observed that problems arose with this substitution. Specifically, the KATHON™ LX biocide was not stable in the presence of HMTA and an alkanolamine, and rapidly lost its effectiveness.

There is a need for a means to provide a formaldehyde-free chemical concentrate(s) for providing a photographic stabilizing solution that inhibits biogrowth while providing image dye stability.

SUMMARY OF THE INVENTION

The present invention solves the problems noted above with a photographic chemical stabilizing kit comprising, individually packaged:

- a first concentrated chemical solution having a pH of from about 6 to about 9, and comprising hexamethylenetetramine (HMTA), and a water-soluble alkanolamine, and
- a second concentrated chemical solution having a pH of from about 4 to about 5, and comprising one or more surfactants, and a biocide mixture comprising the two biocide compounds 5-chloro-2-methyl-4-isothiazolin-3-one and 2-methyl-4-isothiazolin-3-one,
- provided that the HMTA, alkanolamine and two biocide compounds are present in the first and second concentrated chemical solutions such that when the first and second concentrated chemical solutions are diluted from about 5:1 to about 100:1 to form an aqueous stabilizing solution,
- the concentration of HMTA in the stabilizing solution is at least 3 g/l,
- the concentration of the alkanolamine in the stabilizing solution is at least 0.5 g/l, and
- the total concentration of the biocide compounds in the stabilizing solution is at least 20 ppm.

This invention also comprises a method of photographic processing comprising contacting an imagewise exposed, color developed, bleached and fixed silver halide color film with an aqueous stabilizing solution, the stabilizing solution prepared by mixing and diluting from about 5:1 to about 100:1, the first and second concentrated chemical solutions described above.

We have found that a useful stabilizing solution can be prepared from two concentrated chemical solutions that are stable in storage and handling for an extended period of time. By keeping certain required components of a photographic stabilizing solution separated until use, certain isothiazolone biocides are stabilized and can be effectively used to replace others while maintaining their biocidal effectiveness for extended periods of time. Specifically, the loss of activity in the commercially available KATHON™ LX biocides is reduced by keeping them separated from HMTA and alkanolamines prior to use.

Moreover, the two concentrated solutions can be provided individually or as part of a chemical processing kit, and are convenient to use when mixing and diluting with water to form an aqueous stabilizing solution.

DETAILED DESCRIPTION OF THE INVENTION

A first concentrated chemical solution of the photographic chemical kit of this invention is the dye stabilizing agent, HMTA, that has the desirable properties of providing superior dye image stability, while avoiding the formation of drying marks or spots from chemical residues on the processed elements.

Besides HMTA, this solution additionally includes one or more alcoholamines in order to retard sulfurization from any thiosulfate fixing agent carried over from the fixing bath into the stabilizing bath. The term "alkanolamine", as used herein, refers to an amine in which the nitrogen atom is directly attached to a hydroxyalkyl group, that is, the amine comprises an >N—X—OH group wherein X is alkylene. The radicals attached to the free bonds of the nitrogen atom can be hydrogen atoms or organic radicals, for example substituted or unsubstituted hydrocarbon radicals, typically having from 1 to 12 carbon atoms (linear or branched), and can include alkyl, aryl, aralkyl or alkaryl groups.

Preferred alkanolamines useful in this invention include those with the following formula:

$R_1$—N—$(R_2)R_3$ wherein $R_1$ is a substituted or unsubstituted hydroxyalkyl group of 2 to 6 carbon atoms, and each of $R_2$ and $R_3$ is independently a hydrogen atom, a substituted or unsubstituted alkyl group of 1 to 6 carbon atoms, a substituted or unsubstituted hydroxyalkyl group or 2 to 6 carbon atoms, a substituted or unsubstituted benzyl group, or a —$C_nH_{2n}$N—(X)(Y) group wherein n is an integer of from 1 to 6, and each of X and Y is independently a hydrogen atom, a substituted or unsubstituted alkyl group of 1 to 6 carbon atoms, or a substituted or unsubstituted hydroxyalkyl group of 2 to 6 carbon atoms. Representative useful alkanolamines include, but are not limited to, ethanolamine, diethanolamine, triethanolamine, di-isopropanolamine, 2-methylaminoethanol, 2-ethylaminoethanol, 2-dimethylaminoethanol, 1-diethylamino-2-propanol, 3-diethylamino-1-propanol, 3-dimethylamino-1-propanol, 3-amino-1-propanol, 2-amino-2-methyl-1,3-propanediol, ethylenediamine tetraisopropanol, benzyldiethanolamine and 2-amino-2-(hydroxymethyl)1,3-propanediol. Diethanolamine is most preferred.

Other additives may be useful in the first concentrated solution, including one or more nonionic or anionic surfactants, buffering agents, metal ion sequestering agents, hydrophilic polymers and chemical acids, as long as they do not adversely affect the properties of the essential components.

It is particularly useful to include a vinyl pyrrolidone polymer, including a homopolymer of vinyl pyrrolidone, as well as various water-soluble or water-dispersible copolymers of vinyl pyrrolidone and one or more other ethylenically unsaturated polymerizable monomers such as methyl acrylate, methyl methacrylate, ethyl acrylate, vinyl acetate, 4-vinylpyridine, N-acryloylmorpholine, N-acryloxypiperidine and others that would be readily apparent to a skilled worker in the art. Obviously, a skilled artisan would know how to proportion the amounts of various monomers in the copolymers to achieve the desired hydrophilic properties. It is preferred that the copolymers comprises at least 50 mol percent of a vinyl pyrrolidone monomers, such as N-vinyl-2-pyrrolidone. Generally, the vinyl pyrrolidone polymer has a molecular weight in the range of from about 2000 to about 150,000 and more preferably from about 5000 to about 50,000. The most preferred polymer is poly(N-vinyl-2-pyrrolidone) having a molecular weight of about 15,000.

The first concentrated chemical solution generally has a pH of from about 6 to about 9, preferably from about 6.5 to about 8.5, and more preferably from about 7 to about 7.5, as provided by suitable buffers or acids, such as sulfuric acid.

The second concentrated chemical solution of this invention comprises a biocide mixture of 5-chloro-2-methyl-4-isothiazoline-3-one and 2-methyl-4-isothiazolin-3-one. They can be supplied individually or in a mixture, such as the product commercially available as KATHON™ LX biocide from Rohm and Haas. The two compounds are generally present in a weight ratio of from about 40:60 to about 65:35, and preferably, they are present at a weight ratio of from about 55:45 to about 65:35. That is, the 5-chloro-2-methyl-4-isothiazolin-3-one is present in a predominant amount of the biocide mixture.

Copper (II) ions are also generally present in this second concentrated chemical solution to stabilize the biocides. They can be supplied as part of an organic or inorganic salt, such as copper nitrate, copper sulfate or copper acetate, which are commercially available from a number of sources.

One of more surfactants are provided to the stabilizer solution as part of the second concentrated chemical solution. These surfactants can be nonionic or anionic as long as they do not interfere with the other chemical components of the stabilizer solution.

In a preferred embodiment, one or more nonionic surfactants, and one or more anionic surfactants are used in combination. Many useful surfactants are described by tradename in *McCutcheon's Volume* 1: Emulsifiers & Detergents, 1996 North American Edition, McCutcheon Division, MC Publishing Co, Glen Rock, N.J.

Useful nonionic surfactants include, but are not limited to, polyethoxylated surfactants, such as hydrocarbon polyethoxylated surfactants and polyethoxylated silicone surfactants, perfluoroalkyl polyethoxylated surfactants, poly (ethylene oxide)-poly(propylene oxide) surfactants (such as PLURONIC™ L-44 available from BASF Corp.).

Useful hydrocarbon polyethoxylated surfactants include those represented by the formula $R_4$—$(B)_x$—$(E)_m$—D wherein $R_4$ is a substituted or unsubstituted alkyl group having 8 to 20 carbon atoms, B is a phenyl group, x is 0 or 1, E is —$(OCH_2CH_2)$—, m is an integer of from 6 to 20, and D is hydroxy or methoxy. Representative materials having this formula include, but are not limited to, tridecylpolyethyleneoxide(12)alcohol available as RENEX™ 30 from ICI, octylphenoxypolyethyleneoxide (11–12)ethanol available as TRITON™ X-102 from Union Carbide, octylphenoxypolyethyleneoxide(9)ethanol available as TRITON™ X-100 from Union Carbide, octylphenoxypolyethylene-oxide(30–40)ethanol available as TRITON™ X-405 from Union Carbide, alkyl($C_{12-15}$ mixture)polyethyleneoxide-(7)alcohol available as NEODOL™ 25-7 from Shell Chemical Company, and nonylphenoxy poly(hydroxypropylene oxide(8–10))alcohol available as SURFACTANT 10G from Olin Corporation. The preferred surfactant of this class is octylphenoxypolyethyleneoxide(11–12)ethanol.

Useful polyethoxylated silicone surfactants include, but are not limited to, polyalkyleneoxide modified polydimethylsiloxane available as SILWET™ L-7607 from Union Carbide Co.

Useful perfluoroalkylpolyethoxylated surfactants include, but are not limited to, perfluoroalkyl poly(ethylene oxide) alcohols, such as those available as ZONYL™ FSN, ZONYL™ FS 300, or ZONYL™ FSO from DuPont Co, or as FLURAD™ FC-430 or FLUOWET™ TO from American Hoechst.

One or more anionic surfactants can be included also, as long as they are compatible with the other components that will eventually be in the stabilizer solution. Anionic surfactants can include, but are not limited to phosphonates, sulfates and sulfonates. Preferably, the anionic surfactants are sulfonates or sulfates.

Useful sulfates and sulfonates can be represented by the formulae:

$R_5$—(A)—C $(R_6)_n$—$(B)_x$—$(E)_y$—C or $R_7$—O—$(R_8$—$O)_m$—C wherein $R_5$ is a substituted or unsubstituted alkyl group of 8 to 20 carbon atoms (preferably 10–16 carbon atoms), $R_6$ is a substituted or unsubstituted alkyl group of 4 to 20 carbon atoms (preferably 4–16 carbon atoms), $R_7$ is a substituted or unsubstituted alkyl group of 6 to 14 carbon atoms, $R_8$ is ethylene, m is an integer of 1 to 12 (preferably 2 to 12), A is an arylene or hydroxyethylene group, C is —$SO_3^-M^+$ or —$SO_4^-M^+$ wherein $M^+$ is hydrogen or a monovalent cation (ammonium or alkali metal cation), n is 1, 2 or 3, B is a substituted or unsubstituted phenyl group, x or 0 or 1, E is as defined above, and y is an integer of 1 to 8. Some compounds within these formulae include sodium lauryl ether sulfate, sodium dodecylbenzene sulfonate (available as SIPONATE™ DS-10 from Rhone-Poulenc), sodium tributylphenoxypolyethoxysulfate (available as HOSTAPAL™ BV from Hoechst Celanese), sodium alkyl($C_{12-15}$) polyethoxy(5)sulfate (available as WITCOLATE™ SE-5 from Witco), sodium alkyl($C_{12-15}$)polyethoxy(3)sulfate (available as WITCOLATE™ ES-3 from Witco), sodium nonylphenoxypolyethoxy sulfate (available as WITCOLATE™ D51-51 from Witco), sodium 2-hydroxy-tetra, and hexadecane-1-sulfonate (available as WITCOLATE™ AOS from Witco), and sodium alkyl($C_{9-12}$)polyethyleneoxide-(7) ethanesulfonate (available as AVANEL™ S-70 from PPG). Other anionic surfactants are described in U.S. Pat. No. 5,360,700 (Kawamura et al), incorporated by reference.

Other additives can also be included in the second concentrated chemical solution include metal ion sequestering agents, chemical bases, chemical acids, or buffers.

The second concentrated chemical solution generally has a pH of from about 4 to about 5, and preferably from about 4.2 to about 4.8, as provided by any suitable buffer, chemical acid (such as acetic acid or sulfuric acid) or chemical base (such as a hydroxide), in suitable amounts.

The concentration of the components in the first and second concentrated chemical solutions of this invention can vary depending upon the desired dilution to prepare an aqueous working strength stabilizing solution. Generally, either or both concentrated solutions are diluted from about 5:1 to about 100:1, and preferably from about 10:1 to about 70:1. Thus, a skilled worker in the art, upon knowing the desired working strength concentrations of the various components, and the dilution rate, can readily determine with routine experimentation, the concentrations of those components in the two concentrated solutions.

Thus, in the working strength stabilizing solution, the following general and preferred concentrations are desired:

HMTA: generally at least 3 g/l, and preferably at least 3.5 g/l, and generally less than 6 g/l, and preferably less than 5 g/l.

Alkanolamine: generally at least 0.5 g/l, and preferably at least 0.6 g/l, and generally less than 2 g/l, and preferably less than 1 g/l.

Vinyl pyrrolidone polymer: generally at least 0.15 g/l, and preferably at least 0.2 g/l, and generally less than 1 g/l, and preferably less than 0.5 g/l.

Biocide mixture: generally at least 20 ppm and preferably at least 25 ppm, and generally less than 100 ppm and preferably less than 60 ppm.

Nonionic surfactant(s): generally at least 0.02 g/l and preferably at least 0.1 g/l, and generally less than 1 g/l and preferably less than 0.5 g/l.

Anionic surfactant(s): generally at least 0.05 g/l and preferably at least 0.1 g/l, and generally less than 1 g/l and preferably less than 0.5 g/l.

Copper(II) ions: generally at least $1.6\times10^{-4}$ g/l and preferably at least $3.3\times10^{-4}$ g/l, and generally less than 0.003 g/l and preferably less than 0.002 g/l.

The amount of any other additives, including metal ion sequestering agents, buffers, chemical acids and chemical bases would be readily apparent with routine experimentation, especially in view of the teaching in the example below.

The weight ratio of nonionic surfactant(s) to anionic surfactant(s) in the second concentrated chemical solution is generally from about 1:10 to about 10:1, and preferably from about 1:3 to about 3:1.

A preferred photographic chemical stabilizing kit of this invention comprises, individually packaged:

a first concentrated chemical solution having a pH of from about 6.5 to about 8.5, and comprising hexamethylenetetramine in an amount of from about 200 to about 300 g/l, an alkanolamine in an amount of from about 30 to about 75 g/l, poly(vinyl pyrrolidone) in an amount of from about 10 to about 25 g/l, and a metal ion sequestering agent, and a second concentrated chemical solution having a pH of from about 4 to about 5, and comprising a hydrocarbon polyethoxylated nonionic surfactant in an amount of from about 2 to about 20 g/l, a sulfate or sulfonate surfactant in an amount of from about 5 to about 20 g/l, the weight ratio of the nonionic surfactant to said anionic surfactant being from about 1:10 to about 10:1, 5-chloro-2-methyl-4-isothiazolin-3-one and 2-methyl-4-isothiazolin-3-one in a total amount of from about 1 to about 4 g/l, and copper(II) ions in an amount of from about 0.05 to about 0.133 g/l.

The two concentrated chemical solutions can be packaged in and used from any suitable container that is inert to the solution components, including glass and plastic bottles, flexible polymer or laminated containers, vials, tubes, packets and any other vessel known in the art. The individually packaged solutions can be sold, used or transported individually, or as a kit of packaged chemicals.

In preparing a working strength stabilizer solution for processing photographic elements, the first and second concentrated chemical solutions are mixed in a weight ratio of from about 2:1 to about 1:2 (preferably about 1:1) and diluted from about 5:1 to about 100:1 (preferably from about 10:1 to about 70:1) with sufficient water to make 1 liter of solution. Any suitable order of mixing can be used. The working strength stabilizing solution generally has a pH of from about 6 to about 9, and preferably from about 6.5 to about 8.5.

The working strength stabilizer solution is especially useful as the final processing bath for imagewise exposed photographic color materials, such as photographic color films (both color reversal and color negative films) and photographic color papers. More particularly, it is used after color development, bleaching, fixing (or bleach-fixing), and various washing steps that may be used.

Such photographic materials are well known from hundreds of publications, many of which are summarized in *Research Disclosure* No. 38957, published September, 1996 (pages 591–639) by Kenneth Mason Publications, Ltd., Dudley House, 12 North Street, Emsworth, Hampshire PO10 7DQ Great Britain (also from Emsworth Design Inc., 121 West 19th Street, New York, N.Y. 10011). This invention can be practiced to process photographic materials containing any of the many varied silver chloride emulsions, grain crystal morphologies, sensitizing dyes, color couplers and addenda as are known in the art. The materials can have any useful support material, including polyesters, cellulose esters, polycarbonates, glass, metals or resin-coated papers. The supports can also have a magnetic layer on the side opposite the silver halide emulsion layers.

It is preferred that the invention is practiced with photographic color films, such as photographic color negative films. Such useful commercial color negative films are available as KODAK GOLD™ Color Film, KODAK ROYAL GOLD™ Color Film, KODAK ADVANTIX™ Color Films, FUJI SUPER G™ Plus Color Films, FUJI SMARTFILM™ products, FUJI ACE™ and KONICA™ VX Films.

The various processing steps normally used to provide an image from imagewise exposed photographic materials are well known. Thus, color development, bleaching, fixing (bleach-fixing) can be carried out using conventional processing solutions, times and temperatures. In some preferred embodiments, color development can be carried out using a color developer solution containing a conventional color developing agent and one or more hydroxylamine derivative antioxidants, such as those described in U.S. Pat. No. 4,892,804 (Vincent et al) and U.S. Pat. No. 5,646,327 (Burns et al). Bleaching can be carried out using any conventional persulfate, peracid (such as peroxide), or high valent metal ion bleaching agent, such as ferric complexes of various aminopolycarboxylic acid or polyaminopolycarboxylic acid ligands. Useful bleaching agents are described for example in U.S. Pat. No. 5,061,608 (Foster et al), U.S. Pat. No. 5,334,491 (Foster et al), U.S. Pat. No. 5,652,085 (Wilson et al) and U.S. Pat. No. 5,585,226 (Strickland et al). Fixing can be carried out using any useful thioether or thiosulfate fixing agent, as described for example in U.S. Pat. No. 5,424,176 (Schmittou et al). Other color development, bleaching and fixing solutions are described in *Research Disclosure,* noted above.

The stabilizing step of this invention is generally carried out for from about 20 to about 120 seconds at a temperature of from about 20° to about 50° C.

Processing can be carried out in any suitable photographic processor including rack and tank, "dip and dunk", and "low volume thin tank" processors as described for example in U.S. Pat. No. 5,436,118 (Carli et al) and U.S. Pat. No. 5,573,896 (Carli et al).

The following Examples are provided to illustrate the practice of this invention, and not to be limiting in any way. The Comparative Examples are intended to show the problems with concentrates outside the scope of this invention. Unless otherwise noted, percentages are by weight.

COMPARATIVE EXAMPLE A

The following concentrated formulation is commercially known:

| | |
|---|---|
| Water | 358.7 g/l |
| Sulfuric acid | 19.0 g/l |
| HMTA (42%) | 522.9 g/l |
| Diethanolamine (85%) | 55.56 g/l |
| IRGAFORM ™ 3000 (50%) | 5.56 g/l |
| PROXEL ™ GXL biocide (17%) | 19.61 g/l |
| Polyvinyl pyrrolidone (PVP) K-15 (30%) | 46.3 g/l |
| TRITON ™ X-102 surfactant | 11.1 g/l |
| WITCOLATE ™ ES-3 surfactant (28%) | 39.7 g/l |
| pH = 8.4 | |

When PROXEL™ GXL biocide was replaced with KATHON™ LX biocide (14%, 3.97 g/l 10 ppm) and copper nitrate (41%, 0.14 g/l 1 ppm) was added, the new concentrate was then tested for stability of the biocide by keeping the concentrate under the conditions shown in TABLE I. The loss in biocide activity was measured using conventional liquid chromatography procedures. It can be seen that after 14 days, the loss in biocide was unacceptable at either keeping temperature. Under similar conditions, when PROXEL™ GXL biocide was in the concentrate, the loss in biocide after 30 days (21° C.) was 0%, and after 30 days (49° C.), the loss was only 1%.

TABLE I

| TIME | TEMPERATURE | BIOCIDE LEFT (g/l) | % BIOCIDE LOSS |
|---|---|---|---|
| 0 | 21° C. | 4.24 | 0 |
| 14 days | 21° C. | 3.50 | 18 |
| 14 days | 59° C. | 1.44 | 66 |

COMPARATIVE EXAMPLE B

In an attempt to reduce the loss of KATHON™ LX biocide shown in Comparative Example A, concentrates 2A–2F were prepared and brought to 1 liter with water, the concentrates having different pH values (TABLE II).

| Mix 1: | |
|---|---|
| Water | 1255.2 g |
| HMTA (42%) | 3138.0 g |
| Diethanolamine (85%) | 333.6 g |
| IRGAFORM ™ 3000 (50%) | 33.3 g |
| PVP K-15 (30%) | 277.8 g |
| TRITON ™ X-102 surfactant | 66.6 g |
| WITCOLATE ™ ES-3 surfactant (28%) | 238.2 g |

TABLE II

| CONCEN-TRATE | MIX 1 (g) | KATHON ™ BIOCIDE (14%, g) | COPPER NITRATE (41%, g) | SULFURIC ACID(g) | pH |
|---|---|---|---|---|---|
| 2A | 890.0 | 8.0 | 0.28 | 0 | 10.3 |
| 2B | 890.0 | 8.0 | 0.28 | 5.78 | 9.5 |
| 2C | 890.0 | 8.0 | 0.28 | 11.22 | 9.0 |

TABLE II-continued

| CONCEN-TRATE | MIX 1 (g) | KATHON ™ BIOCIDE (14%, g) | COPPER NITRATE (41%, g) | SULFURIC ACID(g) | pH |
|---|---|---|---|---|---|
| 2D | 890.0 | 8.0 | 0.28 | 25.0 | 6.5 |
| 2E | 890.0 | 8.0 | 0.28 | 34.48 | 6.4 |
| 2F | 890.0 | 8.0 | 0.28 | 63.18 | 5.5 |

TABLE III below shows the results of stability tests for these six concentrates. In all of the concentrates, the loss in biocide under the keeping conditions was highly unacceptable. However, a lowering of the pH enhances the stability of the KATHON™ LX biocide.

TABLE III

| CON-CEN-TRATE | TIME | TEMPERATURE °C. | BIOCIDE LEFT (g/l) | % BIOCIDE LOSS |
|---|---|---|---|---|
| 2A | 0 | 21 | 8.21 | 0 |
| " | 1 day | " | 6.47 | 21 |
| " | 11 days | " | 3.06 | 63 |
| 2B | 0 | " | 8.12 | 0 |
| " | 1 day | " | 7.51 | 8 |
| " | 11 days | " | 3.11 | 62 |
| 2C | 0 | " | 8.28 | 0 |
| " | 1 day | " | 7.86 | 5 |
| " | 11 days | " | 3.28 | 60 |
| 2D | 0 | " | 8.27 | 0 |
| " | 1 day | " | 8.0 | 3 |
| " | 11 days | " | 7.94 | 4 |
| " | 13 days | 43 | 2.80 | 66 |
| 2E | 0 | 21 | 8.43 | 0 |
| " | 1 day | " | 8.2 | 3 |
| " | 11 days | " | 8.0 | 5 |
| " | 13 days | 43 | 3.69 | 56 |
| 2F | 0 | 21 | 8.41 | 0 |
| " | 1 day | " | 8.1 | 4 |
| " | 11 days | " | 8.0 | 5 |
| " | 13 days | 43 | 5.11 | 39 |

COMPARATIVE EXAMPLE C

A similar pH series was carried out as described in Comparative Example B except that the diethanolamine was omitted from the concentrate Mix 1. While biocide stability was increased as the pH was lowered, and the stability was increased over that in Comparative Example B, the overall stability was still unacceptable. These experiments indicate that the alkanolamine adversely affects KATHON™ LX biocide stability.

COMPARATIVE EXAMPLE D

A similar pH series was carried out as described in Comparative Example B in order to determined the effect of HMTA stabilizing agent and the IRGAFORM™ 3000 sequestering agent on biocide stability.

| Mix 1: | |
|---|---|
| Water | 527.5 g |
| HMTA (42%) | 1045.8 g |
| Diethanolamine (85%) | 111.12 g |
| PVP K-15 (30%) | 92.6 g |
| TRITON ™ X-102 surfactant | 22.2 g |
| WITCOLATE ™ ES-3 surfactant (28%) | 79.3 g |
| pH 10.81 | |

-continued

| Mix 2: | |
|---|---|
| Water | 1517.4 g |
| IRGAFORM ™ 3000 | 11.2 g |
| Diethanolamine (85%) | 111.12 g |
| PVP K-15 (30%) | 92.6 g |
| TRITON ™ X-102 surfactant | 22.2 g |
| WITCOLATE ™ ES-3 surfactant (28%) | 79.3 g |
| pH = 10.2 | |
| **Mix 3:** | |
| KATHON ™ LX biocide (14%) | 20 g |
| Copper nitrate (41%) | 0.7 g |
| Water | 250 g |

TABLE IV

| CONCENTRATE | (g) | SULFURIC ACID (g) | MIX 3 (g) | pH |
|---|---|---|---|---|
| 4A | 1127.12 of MIX 1 | 28.01 | 32.5 | 7.53 |
| 4B | 866.39 of 4A | 2.32 | 32.5 | 7.03 |
| 4C | 582.17 of 4B | 3.0 | 32.5 | 6.2 |
| 4D | 291.1 of 4C | 8.12 | 32.5 | 5.52 |
| 4E | 1100.24 of MIX 2 | 25 | 32.5 | 7.5 |
| 4F | 281.31 of 4E | 0.56 | 32.5 | 6.9 |
| 4G | 281.31 of 4F | 0.90 | 32.5 | 6.1 |
| 4H | 281.31 of 4G | 1.01 | 32.5 | 5.5 |

TABLE V below shows the results of stability tests for these eight concentrates. In all concentrates containing HMTA, the loss in biocide under the keeping conditions was unacceptable. However, in the concentrates lacking HMTA, stability was acceptable. These results also show that the sequestering agent adversely affected stability only a minor amount.

TABLE V

| CON-CEN-TRATE | TIME | TEMPERATURE °C. | BIOCIDE LEFT (g/l) | % BIOCIDE LOSS |
|---|---|---|---|---|
| 4A | 0 | 21 | 8.41 | 0 |
| " | 16 days | " | 7.78 | 7 |
| " | " | 43 | 3.45 | 59 |
| 4B | 0 | 21 | 8.42 | 0 |
| " | 16 days | " | 7.99 | 5 |
| " | " | 43 | 3.53 | 58 |
| 4C | 0 | 21 | 8.27 | 0 |
| " | 16 days | " | 8.05 | 3 |
| " | " | 43 | 4.67 | 44 |
| 4D | 0 | 21 | 8.44 | 0 |
| " | 16 days | " | 8.2 | 3 |
| " | " | 43 | 5.63 | 33 |
| 4E | 0 | 21 | 7.94 | 0 |
| " | 16 days | " | 7.73 | 3 |
| " | " | 43 | 5.74 | 28 |
| 4F | 0 | 21 | 7.89 | 0 |
| " | 16 days | " | 7.89 | 0 |
| " | " | 43 | 7.01 | 12 |
| 4G | 0 | 21 | 7.91 | 0 |
| " | 16 days | " | 7.91 | 0 |
| " | " | 43 | 7.51 | 6 |
| 4H | 0 | 21 | 7.92 | 0 |
| " | 16 days | " | 7.92 | 0 |
| " | " | 43 | 7.64 | 5 |

COMPARATIVE EXAMPLE E

A final solution was prepared having the following components (HMTA and diethanolamine omitted). Biocide stability was evaluated as described above, with the results shown in TABLE VI below. The biocide stability was acceptable, again indicating that the presence of HMTA and diethanolamine adversely affect biocide stability.

| | |
|---|---|
| Water | 956.8 g/l |
| RENEX ™ surfactant | 14.77 g/l |
| SILWET ™ L7607 surfactant | 20.0 g/l |
| KATHON ™ LX biocide (14%) | 9.80 g/l |
| Copper nitrate (41%) | 0.12 g/l |
| Sodium hydroxide (50%) | 1.0 g/l |
| Acetic acid | 1.6 g/l |
| pH = 4.6 | |

TABLE VI

| TIME | TEMPERATURE °C. | BIOCIDE LEFT (g/l) | % BIOCIDE LOSS |
|---|---|---|---|
| 0 | 21 | 9.80 | 0 |
| 30 days | " | 9.70 | 1 |
| " | 49 | 9.1 | 7 |

EXAMPLE 1

Preferred Chemical Stabilizing Kit

The preferred embodiment of this invention was formulated in two concentrated chemical solutions that can be individually packaged for use or assembly as a photographic chemical processing kit:

| Part A: | |
|---|---|
| Water | 423.77 g/l |
| Sulfuric acid (concentrated) | 19.0 g/l |
| HMTA (42%) | 522.9 g/l |
| Diethanolamine (85%) | 55.56 g/l |
| IRGAFORM ™ 3000 sequestering agent (50%) | 5.56 g/l |
| PVP K-15 (30%) | 46.3 g/l |
| pH = 8.3 | |
| **Part B:** | |
| Water | 939.23 g/l |
| Acetic acid (glacial) | 1.33 g/l |
| Sodium hydroxide (50%) | 0.8 g/l |
| Copper nitrate (41%) | 0.41 g/l |
| KATHON ™ LX biocide (14%) | 12.0 g/l |
| TRITON ™ X-102 surfactant (100%) | 11.11 g/l |
| WITCOLATE ™ ES-3 surfactant (28%) | 39.65 g/l |
| pH = 4.6 | |

To prepare a working strength stabilizing solution, Parts A and B were mixed at 18 ml and 18 ml, respectively, in water sufficient to form 1 liter of a working strength stabilizing solution having a pH of 8.0.

EXAMPLE 2

Alternative Chemical Stabilizing Kit

The two concentrated solutions described in Example 1 were prepared except that the amount of sulfuric acid in Part A was 23 g/l, providing a pH of 7.3, and the amount of KATHON™ LX biocide (14%) in Part B was 20 g/l.

The two solutions (18 ml of each) were mixed and diluted with water to form 1 liter of a working strength stabilizing solution having a pH of 7.0.

EXAMPLE 3

Processing Photographic Color Film

The stabilizer chemical processing kit described in Example 1 was used to prepare a working strength stabilizing solution that was then used in processing photographic color films as follows:

Samples of several commercially available KODAK™ color negative films (such as KODAK GOLD™ Color Film 200 and 400 speed, KODAK ROYAL GOLD™ Color Film 200 speed and KODAK GOLD MAX™ 800 speed) were imagewise exposed, and then color developed, bleached and fixed using the standard process C-41 and conventional processing solutions in a NORITSU™ VS4500 Minilab processor. After the fixing step, the working strength stabilizing solution prepared according to this invention was used to process the film samples for 135 seconds at 38° C. The film samples were then dried.

The invention has been described in detail with particular reference to preferred embodiments thereof, but it will be understood that variations and modifications can be effected within the spirit and scope of the invention.

We claim:

1. A photographic chemical stabilizing kit comprising, individually packaged:

a first concentrated chemical solution having a pH of from about 6 to about 9, and comprising hexamethylenetetramine (HMTA), and a water-soluble alkanolamine, and a second concentrated chemical solution having a pH of from about 4 to about 5, and comprising one or more surfactants, and a biocide mixture comprising the two biocide compounds 5-chloro-2-methyl-4isothiazolin-3-one and 2-methyl-4-isothiazolin-3-one, provided that said HMTA, alkanolamine and two biocide compounds are present in said first and second concentrated chemical solutions such that when said first and second concentrated chemical solutions are diluted from about 5:1 to about 100:1 to form an aqueous stabilizing solution, the concentration of said HMTA in said stabilizing solution is at least 3 g/l, the concentration of said alkanolamine in said stabilizing solution is at least 0.5 g/l, and the total concentration of said biocide compounds in said stabilizing solution is at least 5 ppm.

2. The stabilizing kit of claim 1 wherein HMTA is present in said first concentrated chemical solution at a concentration such that upon said dilution, the concentration of HMTA in said stabilizing solution is from about 3 to about 6 g/l, and said alkanolamine is present in said first concentrated chemical solution at a concentration such that upon said dilution, the concentration of said alkanolamine is from about 0.5 to about 2 g/l.

3. The stabilizing kit of claim 1 wherein said two biocide compounds are present in said second concentrated chemical solution in an amount such that upon said dilution, the total concentration of said biocide compounds is from about 25 to about 70 ppm, and the weight ratio of 5-chloro-2-methyl-4-isothiazoline-3-one to 2-methyl-4-isothiazolin-3-one is from about 40:60 to about 65:35.

4. The stabilizing kit of claim 1 wherein said second concentrated chemical solution further comprises copper(II) ions at a concentration such that upon said dilution, the concentration of copper(II) ions in said stabilizing solution is at least $1.6\times10^{-4}$ g/l.

5. The stabilizing kit of claim 1 wherein said second concentrated chemical solution comprises one or more nonionic surfactants and one or more anionic surfactants.

6. The stabilizing kit of claim 5 wherein said nonionic surfactant is a hydrocarbon polyethoxylated surfactant, a polyethoxylated silicone surfactant, a perfluoroalkyl polyethoxylated surfactant or a poly(ethylene oxide)-poly (propylene oxide) surfactant.

7. The stabilizing kit of claim 5 wherein said anionic surfactant is a sulfonate or sulfate.

8. The stabilizing kit of claim 5 wherein said one or more nonionic surfactants are present in said second concentrated solution such that upon said dilution, the concentration of said nonionic surfactant(s) in said stabilizing solution is at least 0.02 g/l, and said one or more anionic surfactants are present in said second concentrated solution such that upon said dilution, the concentration of said anionic surfactant(s) is at least 0.05 g/l, and the weight ratio of nonionic surfactant(s) to anionic surfactant(s) is from about 1:10 to about 10:1.

9. The stabilizing kit of claim 1 wherein said first concentrated chemical solution further comprises a vinyl pyrrolidone polymer in an amount such that upon said dilution, the concentration of said polymer in said stabilizing solution is at least 0.15 g/l.

10. A photographic chemical stabilizing kit comprising, individually packaged:

a first concentrated chemical solution having a pH of from about 6.5 to about 8.5, and comprising hexamethylenetetramine in an amount of from about 200 to about 300 g/l, an alkanolamine in an amount of from about 30 to about 75 g/l, poly(vinyl pyrrolidone) in an amount of from about 10 to about 25 g/l, and a metal ion sequestering agent, and a second concentrated chemical solution having a pH of from about 4 to about 5, and comprising a hydrocarbon polyethoxylated nonionic surfactant in an amount of from about 2 to about 20 g/l, a sulfate or sulfonate surfactant in an amount of from about 5 to about 20 g/l, the weight ratio of said nonionic surfactant to said anionic surfactant being from about 1:10 to about 10:1, 5-chloro-2-methyl-4-isothiazolin-3-one and 2-methyl-4-isothiazolin-3-one in a total amount of from about 1 to about 4 g/l, and copper(II) ions in an amount of from about 0.05 to about 0.133 g/l.

11. A method of processing comprising contacting an imagewise exposed, color developed, bleached and fixed silver halide color film with an aqueous stabilizing solution, said stabilizing solution prepared by mixing and diluting from about 5:1 to about 100:1, the following solutions:

a first concentrated chemical solution having a pH of from about 6 to about 9 and comprising hexamethylenetetramine (HMTA), and an alkanolamine, and a second concentrated chemical solution having a pH of from about 4 to about 5 and comprising one or more surfactants, and a biocide mixture comprising the two biocide compounds 5-chloro-2-methyl-4-isothiazolin-3-one and 2-methyl-4-isothiazolin-3-one, provided that said HMTA, alkanolamine and two biocide compounds are present in said first and second concentrated chemical solutions such that upon said dilution to form said aqueous stabilizing solution, the concentration of said HMTA in said stabilizing solution is at least 3 g/l, the concentration of said alkanolamine in said stabilizing solution is at least 0.5 g/l, and the total concentration of said biocide compounds in said stabilizing solution is at least 5 ppm.

12. The method of claim 11 wherein each of said first and second concentrated chemical solutions are individually diluted from about 10:1 to about 70:1 to form said stabilizing solution.

13. The method of claim 11 wherein said processed color film is a color negative film.

14. The method of claim 11 wherein HMTA is present in said first concentrated chemical solution at a concentration such that upon said dilution, the concentration of HMTA in said stabilizing solution is from about 3 to about 6 g/l, said alkanolamine is present in said first concentrated chemical solution at a concentration such that upon said dilution, the concentration of said alcoholamine is from about 0.5 to about 2 g/l, said two biocide compounds are present in said second concentrated chemical solution in an amount such that upon said dilution, the total concentration of said biocide compounds is from about 25 to about 60 ppm, and the weight ratio of 5-chloro-2-methyl-4-isothiazoline-3-one to 2-methyl-4-isothiazoline-3-one is from about 40:60 to about 65:35.

15. The method of claim 11 wherein said second concentrated chemical solution further comprises copper(II) ions at a concentration such that upon said dilution, the concentration of copper(II) ions in said stabilizing solution is at least $1.6\times10^{-4}$ g/l, and said second concentrated chemical solution comprises one or more nonionic surfactants and one or more anionic surfactants.

16. The method of claim 15 wherein said nonionic surfactant is a hydrocarbon polyethoxylated surfactant, a polyethoxylated silicone surfactant, a perfluoroalkyl polyethoxylated surfactant or a poly(ethylene oxide)-poly(propylene oxide) surfactant, and said anionic surfactant is a sulfonate or sulfate.

17. The method of claim 16 wherein said one or more nonionic surfactants are present in said second concentrated solution such that upon said dilution, the concentration of said nonionic surfactant(s) in said stabilizing solution is at least 0.02 g/l, and said one or more anionic surfactants are present in said second concentrated solution such that upon said dilution, the concentration of said anionic surfactant(s) is at least 0.05 g/l, and the weight ratio of nonionic surfactant(s) to anionic surfactant(s) is from about 1:10 to about 10:1.

18. The method of claim 11 wherein said first concentrated chemical solution further comprises a vinyl pyrrolidone polymer in an amount such that upon said dilution, the concentration of said polymer in said stabilizing solution is at least 0.15 g/l.

19. The method of claim 11 wherein said first concentrated chemical solution has a pH of from about 7 to about 7.5, and said second concentrated chemical solution has a pH of from about 4.2 to about 4.8.

20. The method of claim 11 wherein said stabilizing solution has a pH of from about 6.5 to about 8.5.

* * * * *